US008991137B2

(12) United States Patent
Molinelli

(10) Patent No.: US 8,991,137 B2
(45) Date of Patent: Mar. 31, 2015

(54) METHOD OF MAKING HOUSING COMPONENTS

(71) Applicant: Michael Molinelli, Briarcliff Manor, NY (US)

(72) Inventor: Michael Molinelli, Briarcliff Manor, NY (US)

(73) Assignees: St Bungalow LLC, Briarcliff Manor, NY (US); Michael Molinelli, Briarcliff Manor, NY (US)

( * ) Notice: Subject to any disclaimer, the term of this patent is extended or adjusted under 35 U.S.C. 154(b) by 0 days.

(21) Appl. No.: 14/196,060

(22) Filed: Mar. 4, 2014

(65) Prior Publication Data

US 2014/0245691 A1 Sep. 4, 2014

Related U.S. Application Data

(60) Provisional application No. 61/772,040, filed on Mar. 4, 2013.

(51) Int. Cl.
*E04G 11/46* (2006.01)
*E04C 2/04* (2006.01)
*B28B 7/00* (2006.01)

(52) U.S. Cl.
CPC ..... *E04C 2/041* (2013.01); *B28B 7/0032* (2013.01); *B28B 7/0055* (2013.01); *B28B 7/0088* (2013.01); *B28B 7/0094* (2013.01)
USPC ..... 52/783.11; 52/783.17; 52/783.19; 52/798.1; 249/28; 249/30; 249/176; 249/188

(58) Field of Classification Search
CPC .. B28B 7/0032; B28B 7/0055; B28B 7/0088; B28B 7/0094; E04G 11/46
USPC ..... 52/782.1, 783.11, 783.12, 783.17, 52/783.19, 784.1, 787.11, 798.1; 264/32–33; 249/28–32, 175–178, 183, 249/188
See application file for complete search history.

(56) References Cited

U.S. PATENT DOCUMENTS

| | | | | |
|---|---|---|---|---|
| 3,278,116 | A * | 10/1966 | Petty | 52/750 |
| 3,397,497 | A * | 8/1968 | Shea et al. | 52/334 |
| 3,592,437 | A * | 7/1971 | Dashew | 249/175 |
| 3,871,278 | A * | 3/1975 | Shoemaker | 105/378 |
| 4,041,671 | A * | 8/1977 | Nicholson | 52/745.07 |
| 4,149,351 | A * | 4/1979 | Belt | 52/745.07 |
| 5,105,590 | A * | 4/1992 | Dykmans | 52/745.01 |
| 5,397,096 | A * | 3/1995 | Nelson | 249/31 |
| 7,028,436 | B2 * | 4/2006 | Bezubic, Jr. | 52/288.1 |
| 8,104,233 | B2 | 1/2012 | Wilsey | |
| 8,444,722 | B2 * | 5/2013 | Richey | 44/605 |
| 2004/0128936 | A1 * | 7/2004 | Gilbert | 52/604 |
| 2007/0294954 | A1 * | 12/2007 | Barrett et al. | 52/36.2 |

FOREIGN PATENT DOCUMENTS

GB 2491649 A * 12/2012

* cited by examiner

*Primary Examiner* — Jeanette E Chapman
(74) *Attorney, Agent, or Firm* — Keith D. Nowak; Libby Babu Varghese; Carter Ledyard & Milburn LLP

(57) ABSTRACT

A housing component system having fiberglass resin forms secured in place with a binder such as cement. The forms may have a variety of forms and once secured with the cement will be strong avoiding the need for any reinforcement components such as reinforcing bar (rebars) of metal mesh.

9 Claims, 4 Drawing Sheets

METHOD OF MAKING HOUSING COMPONENTS

PRIORITY AND RELATED APPLICATION

This application claims priority to U.S. Provisional Patent Application Ser. No. 61/772,040, filed Mar. 4, 2013, entitled "Method of Making a Roof," which is hereby incorporated by reference in its entirety.

FIELD OF THE INVENTION

The present invention relates to a method of making parts of housing such as walls or roofs.

BACKGROUND OF THE INVENTION

Today many people in the world are without decent housing, or any housing at all. In addition, houses that are off-grid have no energy supply, beyond what can be obtained from primitive means, such as wood, kerosene, etc. A solar powered eco-friendly home or "solar bungalow" would be ideal for solving this need. In much of Africa, and in other parts of the world, families without access to electricity rely on kerosene lamps. Expensive, unsafe and unhealthy, they also provide only a dim light. But while solar alternatives are far cleaner and cheaper, widespread use of this technology will rely on innovative forms of payment and distribution. Inexpensive housing units that offer the possibility of simultaneously attaching solar panels will be of great benefit. Such housing units will have to be affordable and preferably eco-friendly. Housing units comprised of compressed earth bricks are an example of the kind of buildings needed. Corresponding inexpensive housing parts such as roofs for these housing units are of equal importance in order to bring down the overall price of the housing unit.

Accordingly, what is desired is a method of making inexpensive housing components that use fiberglass and concrete but does not use steel in any form. A method is desired that is a total structural housing part system. A method is desired that uses a single layer rigid fiberglass form potentially well-suited for a compressed earth brick (CEB) bungalow design. Also it is desired that the form be free of iron or wire meshes and be continuous without voids between a top and bottom panel of concrete. It is also desired to provide a method that imparts additional strength and creates a flat surface for a floor or roof for instance, on which a second story for living space or storage can be built. It is further desired that fiberglass resin be used as a form and be able to distort in two directions allowing a concrete shell to handle structural work. A method is desired that will produce a structure that is light and therefore less costly to ship. The method should provide a permanent housing component that is meant to span long distances. The method is further desired that will provide housing components that have internal strength.

BRIEF SUMMARY OF THE INVENTION

A housing component formed of a plurality of single rigid fiberglass arch forms secured in place with a binder such as cement or eco-bricks. The forms are placed parallel to each other and secured on or in an edifice with a temporary shore that receives and retains a binder. The temporary shore is removed once the binder cures.

DETAILED DESCRIPTION OF THE INVENTION

Figure 1:
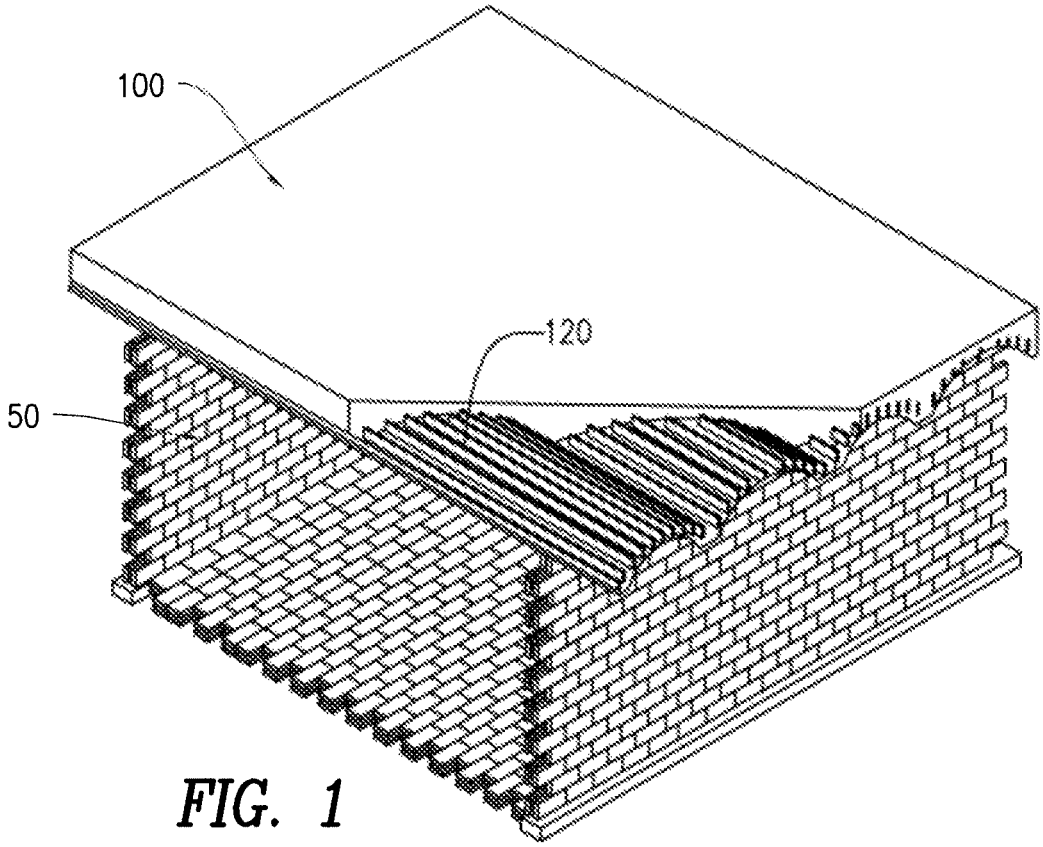
FIG. 1 shows a housing component of the present invention, the housing component shown in FIG. 1 is a roof system disposed on an edifice.
Figure 2:
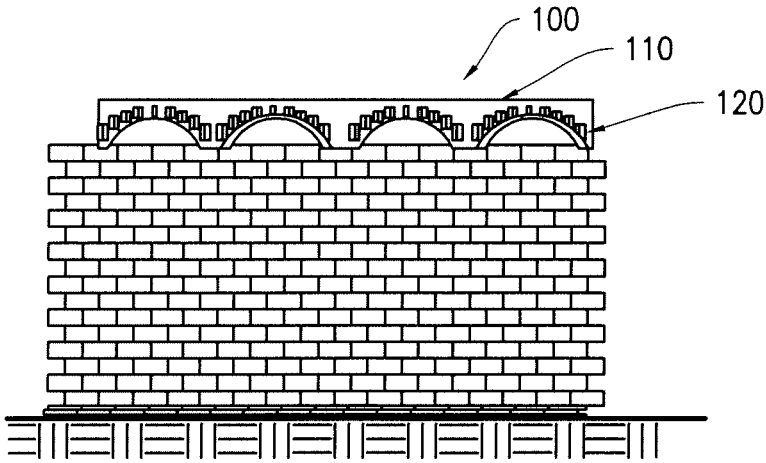
FIG. 2 is a side view of the roof system in FIG. 1.
Figure 3:
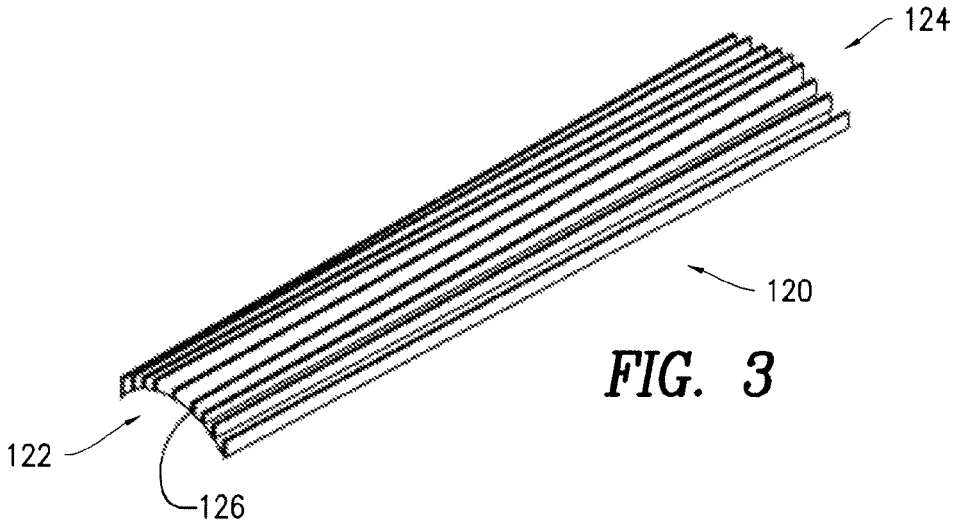
FIG. 3 shows one housing component form as shown in FIG. 1.
Figure 4:
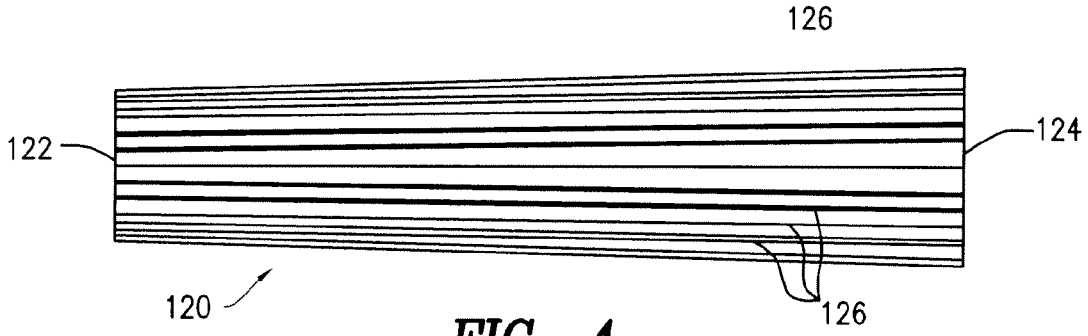
FIG. 4 shows a plan view of FIG. 3.
Figure 5A:
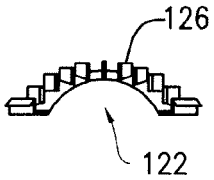
FIGS. 5A and 5B show end views of FIG. 3.
Figure 5B:
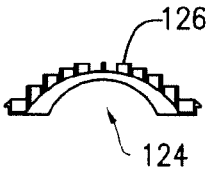

FIG. 1 shows a thin-shelled roof system 100 on an edifice 50. The roof 100 comprises arched forms 120 and cement, ferro-cement or concrete 110. Forms 120 are placed parallel to each other on the edifice 50 and once in place cement 110 is poured on top and contained on top with a temporary perimeter that is removed once set. The form 120 may comprise a fiberglass concrete form that remains in place once the concrete 110 cures. See FIG. 2. The form 120 thus can become an integral part of the thin-shelled roof system. The form itself can take the shape of a trapezoid as shown in FIGS. 3 and 4.

Looking now to FIGS. 3-5B the form 120 is shown to have ends 122 and 124 and fins 126. End 122 is narrower than end 124. The fins 127 may be trapezoid shaped but could be any other shape as well. With a trapezoid shaped fin the form 120 deforms in two planes this gives the roof strength and also allow the components to fit together. The distorted configuration of the form 120 may also allow the roof 100 to be strong and avoid the need for any reinforcement components such as reinforcing bar (rebars) of metal mesh. Form 120 may have any dimension in one embodiment the form may be about 548 cm long, 96.8 cm at end 122 and 127.3 cm at end 124. Form 120 can support a live load of 244 kilograms per square meter (50 PSF).

Figure 6:
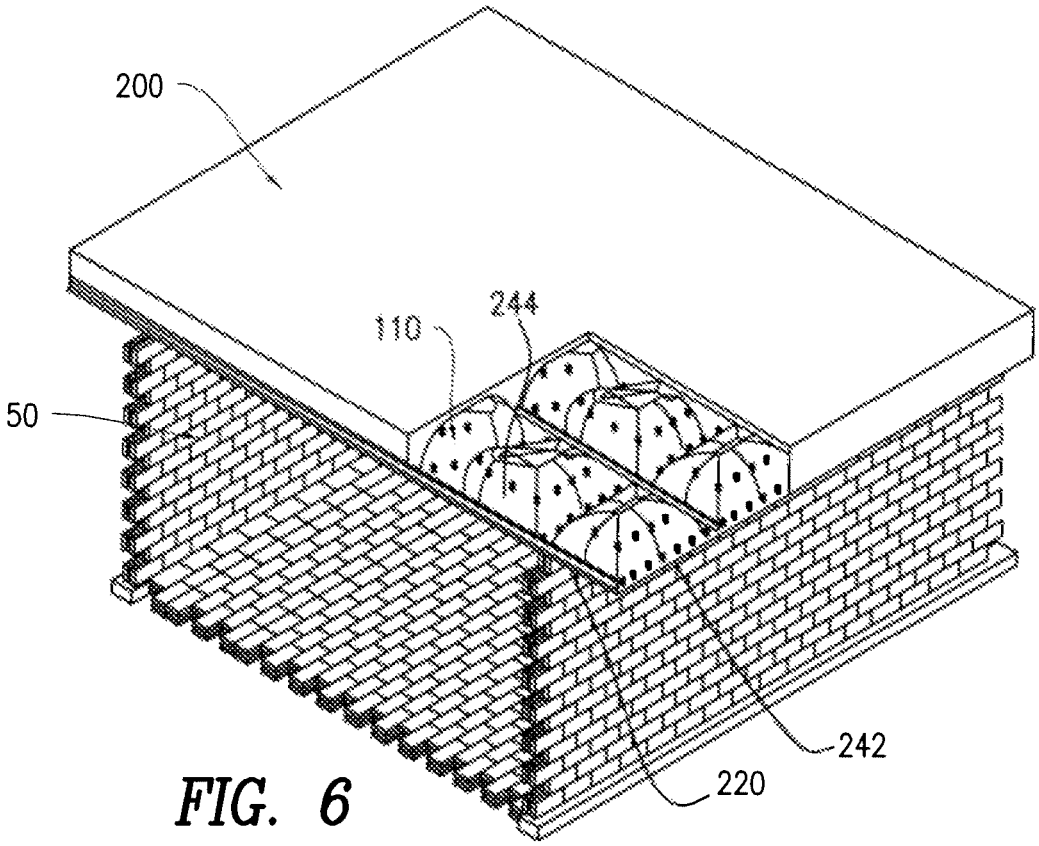
FIG. 6 shows a second embodiment of the housing component of the present invention, the housing component shown in FIG. 6 is a roof system disposed on an edifice.
Figure 7:
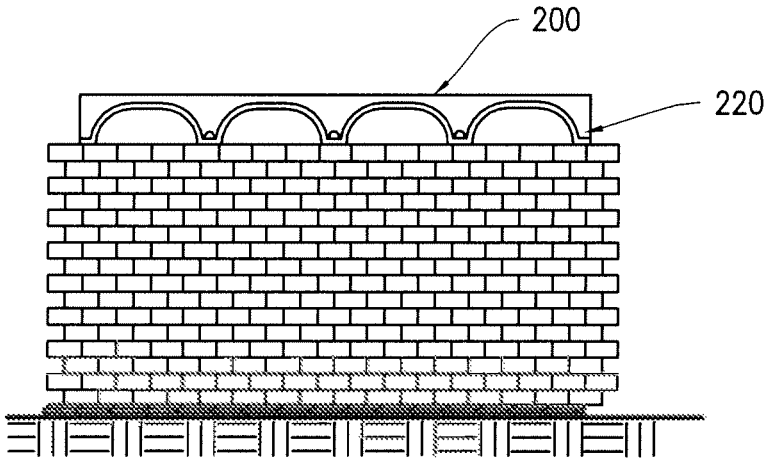
FIG. 7 is a side view of the roof system in FIG. 6.
Figure 8:
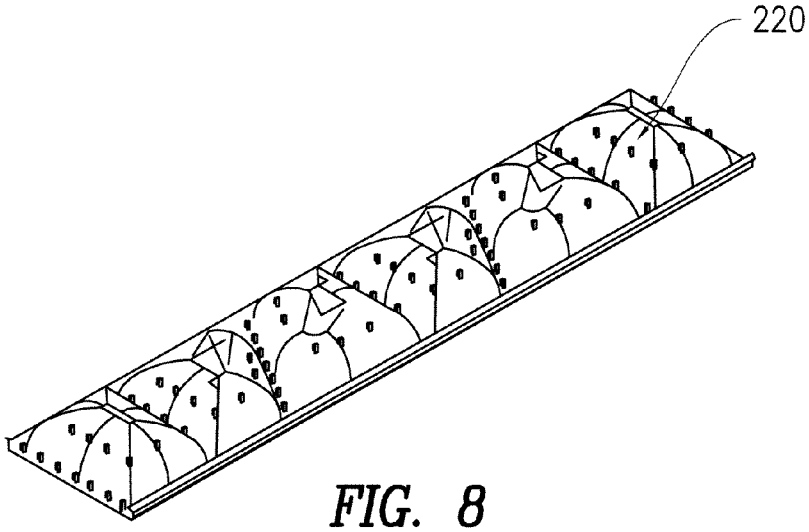
FIG. 8 shows one housing component form as shown in FIG. 6.
Figure 9:
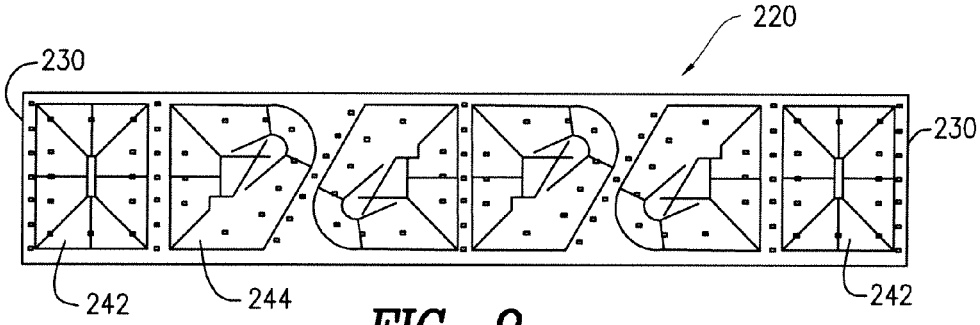
FIG. 9 shows a plan view of FIG. 6.
Figure 10:
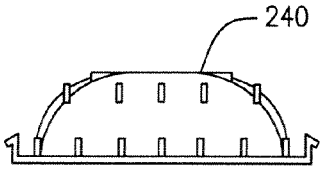
FIG. 10 shows an end view of FIG. 6.

FIGS. 6-10 shows a thin-shelled roof system 200 that is another embodiment of system 100. FIG. 6 shows system 200 comprising forms 220 and cement, ferro-cement or concrete 110. The forms 220 are placed next to each other on edifice 50 and, like system 100, cement 110 is poured on top and contained on top with a temporary perimeter that is removed once set. Here too the form 220 may comprise a fiberglass concrete form that remains in place once the concrete 110 cures. Form 220 employ domes 220 that are either symmetrical 242 or asymmetrical 244. The irregularity increases the deformation in two planes increasing strength. The ends 230 of the form 220 are uniform as they have the same dimension. Forms 220 can span 265 CM (12') with an overhang for a total of 549 cm (18') and support a live load of 244 kilograms per square meter (50 PSF).

As mentioned above, systems 100, 200 provide fiberglass-resin forms that once secured are made permanent by pouring cement 110 on the forms 120, 220 on site. Temporary shoring is required as the cement 110 cures. The forms 120, 220 are stackable and interlocking and can be packed in a container for shipping. Each form 120, 220 is a single rigid layer of fiberglass per arch. In an alternative embodiment, instead of using cement 110 eco-bricks (ecbs) may be used as filler material. The above-described systems 100, 200 may equally be used to form other housing components such as a floor or walls.

While the present invention has been described in conjunction with specific embodiments, those of normal skill in the art will appreciate the modifications and variations can be made without departing from the scope and the spirit of the present invention. Such modifications and variations are envisioned to be within the scope of the appended claims.

The invention claimed is:

1. A housing component system comprising:

a plurality of single rigid fiberglass forms having protrusions, said protrusions deforming each said form in two planes, said forms being trapezoidal in shape;

a binder, wherein the forms are placed parallel to each other and secured on an edifice with a temporary shore to receive said binder on said forms and within said temporary shore wherein said fins are said protrusions that deform said form in two planes, said fins being trapezoidal in shape.

2. The system of claim 1 wherein the forms are arched.

3. The system of claim 1 wherein the forms have domes.

4. The system of claim 1 wherein the binder is cement.

5. The system of claim 1 wherein the housing components form a floor.

6. The system of claim 1 wherein the housing components form a wall.

7. A roof system comprising:

a plurality of single rigid fiberglass arch forms having protrusions, said protrusions deforming each said form in two planes, each form being trapezoidal in shape;

a binder, wherein the forms are placed parallel to each other and secured on an edifice with a temporary shore to receive said binder on said forms and within said temporary shore wherein said fins are said protrusions that deform said form in two planes, said fins being trapezoidal in shape.

8. The system of claim 7 wherein the forms have domes, wherein said domes are said protrusions that deform said form in two planes.

9. The system of claim 7 wherein the binder is cement.

* * * * *